US010535943B2

(12) United States Patent
Szymura et al.

(10) Patent No.: US 10,535,943 B2
(45) Date of Patent: Jan. 14, 2020

(54) RADIAL CONTACT SOCKET

(71) Applicant: Amphenol-Tuchel Electronics GmbH, Heilbronn (DE)

(72) Inventors: Dawid Szymura, Ilsfeld (DE); Christian Ungerer, Untergruppenbach-Unterheinriet (DE)

(73) Assignee: Amphenol-Tuchel Electronics GmbH, Heilbronn (DE)

( * ) Notice: Subject to any disclaimer, the term of this patent is extended or adjusted under 35 U.S.C. 154(b) by 0 days.

(21) Appl. No.: 16/069,368

(22) PCT Filed: Dec. 13, 2016

(86) PCT No.: PCT/EP2016/080853
§ 371 (c)(1),
(2) Date: Jul. 11, 2018

(87) PCT Pub. No.: WO2017/121564
PCT Pub. Date: Jul. 20, 2017

(65) Prior Publication Data

US 2019/0036260 A1 Jan. 31, 2019

(30) Foreign Application Priority Data

Jan. 12, 2016 (DE) ..... 20 2016 100 095 U

(51) Int. Cl.
*H01R 13/187* (2006.01)
*H01R 13/11* (2006.01)
*H01R 43/16* (2006.01)

(52) U.S. Cl.
CPC ..... *H01R 13/187* (2013.01); *H01R 13/111* (2013.01); *H01R 43/16* (2013.01)

(58) Field of Classification Search
CPC ..... H01R 13/187; H01R 13/111
See application file for complete search history.

(56) References Cited

U.S. PATENT DOCUMENTS 3,120,989 A * 2/1964 Solorow ..... H01R 13/187 439/843
3,704,441 A * 11/1972 Douglass ..... H01R 9/16 439/870

(Continued)

FOREIGN PATENT DOCUMENTS

DE 102012221384 A1 5/2013
DE 102011105821 B4 9/2013

(Continued)

*Primary Examiner* — Ross N Gushi
(74) *Attorney, Agent, or Firm* — Blank Rome LLP

(57) ABSTRACT

The invention relates to an electric plug connector socket (1) comprising a cylindrical socket sleeve (2), wherein the socket sleeve (2) is formed with a receiving space (20) in which a cylindrical lamination cage (3) having a multiplicity of contact laminations (31) running in parallel is pushed, wherein the lamination cage (3) has a first and second end-side encircling collar web (32*a*, 32*b*), between which the contact laminations (31) run, characterized in that the lamination cage (3) is clamped and/or fastened at the one (first) end at least axially and preferably also non-rotatably in the socket sleeve (2), and an axial and rotatable plain bearing in relation to the socket sleeve (2) is provided at the other (second) opposite end.

10 Claims, 1 Drawing Sheet

(56) References Cited

Figure 1:
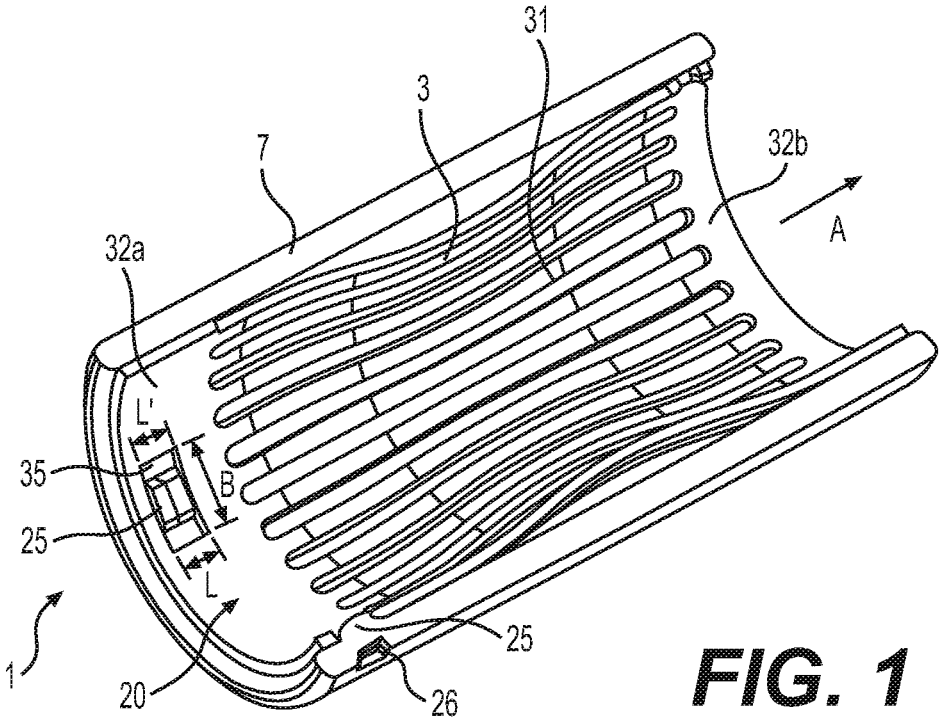

U.S. PATENT DOCUMENTS 4,083,622 A * 4/1978 Neidecker ..... H01R 13/187 439/843
4,120,556 A * 10/1978 Waldron ..... H01R 4/20 439/682
4,128,293 A * 12/1978 Paoli ..... H01R 13/187 439/827
4,572,606 A * 2/1986 Neumann ..... H01R 13/187 439/843
4,657,335 A * 4/1987 Koch ..... H01R 13/187 439/851
4,662,706 A * 5/1987 Foley ..... H01R 13/187 439/843
4,693,002 A * 9/1987 Neumann ..... H01R 13/187 29/882
4,720,157 A * 1/1988 Nestor ..... H01R 13/187 439/843
4,734,063 A * 3/1988 Koch ..... H01R 13/187 439/844
4,749,357 A * 6/1988 Foley ..... H01R 12/7088 439/65
4,750,897 A * 6/1988 Neidecker ..... H01R 13/187 439/825
4,752,253 A * 6/1988 Neumann ..... H01R 13/05 439/825
4,840,587 A * 6/1989 Lancella ..... H01R 13/187 439/851
4,906,211 A * 3/1990 Bell ..... H01R 13/187 439/843
5,036,583 A * 8/1991 Prochaska ..... H01R 13/187 29/874
5,088,942 A * 2/1992 Welsh ..... H01R 43/16 439/843
5,147,229 A * 9/1992 Nestor ..... H01R 13/187 439/843
5,326,289 A * 7/1994 Leisey ..... H01R 13/111 29/882
5,591,039 A * 1/1997 Matthews ..... H01R 13/53 439/181
5,601,457 A * 2/1997 Le Gall ..... H01R 13/187 439/843
5,658,174 A * 8/1997 Benes ..... H01R 13/187 439/843
5,667,413 A * 9/1997 Trafton ..... H01R 13/187 439/271
5,730,628 A * 3/1998 Hawkins ..... A61N 1/3752 439/843
5,810,627 A * 9/1998 Gierut ..... H01R 13/187 439/843
5,857,879 A * 1/1999 Endo ..... H01R 43/16 439/843
5,921,822 A * 7/1999 Kennedy ..... H01R 13/187 439/851
5,951,308 A * 9/1999 Rea ..... H01R 13/18 439/125
6,017,253 A * 1/2000 Schramme ..... H01R 13/187 439/353
6,042,432 A * 3/2000 Hashizawa ..... H01R 13/187 439/843
6,062,919 A * 5/2000 Trafton ..... H01R 13/187 439/843
6,250,974 B1 * 6/2001 Kerek ..... H01R 13/187 439/843
6,254,439 B1 * 7/2001 Endo ..... H01R 13/187 439/843
6,287,156 B1 * 9/2001 Swan ..... H01R 13/187 439/790
6,296,519 B1 * 10/2001 Hashizawa ..... H01R 13/6599 439/607.42
6,379,183 B1 * 4/2002 Ayres ..... H01R 9/0515 439/578
6,425,786 B1 * 7/2002 Scholler ..... H01R 13/187 439/843
6,520,998 B1 * 2/2003 Scholler ..... H01R 13/187 439/843
6,536,107 B1 * 3/2003 Scholler ..... H01R 13/111 29/825
6,656,002 B2 * 12/2003 Zhao ..... H01R 11/22 439/787
6,682,357 B2 * 1/2004 Sikora ..... H01R 13/20 439/125
6,752,668 B2 * 6/2004 Koch, Jr. ..... H01R 13/187 439/387
6,767,260 B2 * 7/2004 Beloritsky ..... H01R 13/187 439/843
6,837,756 B2 * 1/2005 Swearingen ..... H01R 4/4881 439/843
6,875,063 B2 * 4/2005 Zhao ..... H01R 11/22 439/787
6,899,571 B1 * 5/2005 Koch ..... H01R 4/4881 439/843
7,014,516 B2 * 3/2006 Yang ..... H01R 13/187 439/170
7,048,596 B2 * 5/2006 Swearingen ..... H01R 4/4881 439/843
7,115,003 B2 * 10/2006 Zhao ..... H01R 11/22 439/851
7,186,121 B1 * 3/2007 Costello ..... H01R 12/7005 439/79
7,191,518 B2 * 3/2007 Beloritsky ..... H01R 13/187 29/747
7,387,532 B1 * 6/2008 Mao ..... H01R 13/187 439/263
7,387,548 B2 * 6/2008 Takehara ..... H01R 13/187 439/843
7,445,001 B2 * 11/2008 Sikora ..... H01R 13/111 123/634
7,462,078 B2 * 12/2008 Mao ..... H01R 13/187 439/843
7,520,787 B2 * 4/2009 Waltz ..... H01R 4/64 439/816
7,736,194 B1 * 6/2010 Chang ..... H01R 13/111 439/578
7,762,856 B2 * 7/2010 Friesen ..... H01R 4/185 439/843
7,775,841 B2 * 8/2010 Coe ..... H01R 13/187 439/843
7,828,609 B2 * 11/2010 Li ..... H01R 13/187 29/862
7,841,906 B2 * 11/2010 Dent ..... H01R 13/187 439/489
7,938,680 B1 * 5/2011 Hsieh ..... H01R 13/187 439/578
8,137,144 B1 * 3/2012 Wang ..... H01R 13/187 439/78
8,142,238 B2 * 3/2012 Heigl ..... H01R 13/111 439/843
8,272,901 B2 * 9/2012 Rossman ..... H01R 4/183 439/660
8,731,671 B2 * 5/2014 Rodby ..... A61N 1/3752 439/843
8,734,167 B2 * 5/2014 Aimoto ..... H01R 13/187 439/74
8,784,143 B2 * 7/2014 Edgell ..... A61N 1/3752 439/246
8,827,755 B2 * 9/2014 Blakborn ..... H01R 13/113 439/845
8,851,940 B2 * 10/2014 Friedhof ..... H01R 13/111 439/843
8,959,763 B2 * 2/2015 Wu ..... H01R 13/187 29/876
9,236,682 B2 * 1/2016 Glick ..... H01R 13/62
9,352,708 B2 * 5/2016 Mott ..... B60L 53/31
9,379,468 B2 * 6/2016 Zieman ..... H01R 12/91
9,455,514 B2 * 9/2016 Hirakawa ..... H01R 13/02
9,484,641 B2 * 11/2016 Ohkubo ..... H01R 13/187
9,484,644 B2 * 11/2016 Ohkubo ..... H01R 13/04
9,490,562 B2 * 11/2016 Verity ..... H01R 13/111
9,515,403 B2 * 12/2016 Hirakawa ..... H01R 4/184

(56) References Cited

U.S. PATENT DOCUMENTS 9,601,845 B2 * 3/2017 Ando ..... H01R 13/193
9,608,341 B2 * 3/2017 Saur ..... H01R 4/48
9,673,549 B2 * 6/2017 Nakano ..... H01R 13/187
9,761,983 B2 * 9/2017 Mott ..... B60L 53/31
9,979,111 B2 * 5/2018 Yoshioka ..... H01R 13/187
9,985,376 B2 * 5/2018 Zhang ..... H01R 13/426
10,050,366 B2 * 8/2018 Chevreau ..... H01R 13/10
10,122,109 B1 * 11/2018 Hirakawa ..... H01R 13/113
10,135,167 B2 * 11/2018 Wollitzer ..... H01R 13/187
10,135,180 B2 * 11/2018 Sturgess ..... H01R 4/4881
2002/0187686 A1 * 12/2002 Zhao ..... H01R 11/22
439/843
2003/0060090 A1 * 3/2003 Allgood ..... H01R 11/289
439/845
2003/0068931 A1 * 4/2003 Swearingen ..... H01R 4/4881
439/843
2003/0077950 A1 * 4/2003 Swearingen ..... H01R 4/4881
439/843
2004/0003498 A1 * 1/2004 Swearingen ..... H01R 13/187
29/862
2004/0033732 A1 * 2/2004 Koch, Jr. ..... H01R 13/187
439/843
2004/0229490 A1 * 11/2004 Bernat ..... H01R 13/6315
439/246
2009/0061700 A1 * 3/2009 Coe ..... H01R 13/187
439/843
2010/0191299 A1 * 7/2010 Ayzenberg ..... A61N 1/3752
607/2
2012/0282823 A1 * 11/2012 Glick ..... H01R 13/187
439/877
2012/0315802 A1 * 12/2012 Blakborn ..... H01R 13/113
439/700
2014/0017960 A1 * 1/2014 Friedhof ..... H01R 13/111
439/851
2014/0357137 A1 * 12/2014 Sian ..... H01R 13/187
439/843
2015/0207255 A1 * 7/2015 Sugiyama ..... H01R 13/193
439/852
2015/0244096 A1 * 8/2015 Uppleger ..... H01R 13/111
439/682
2016/0134044 A1 * 5/2016 Hirakawa ..... H01R 4/184
439/816
2016/0226181 A1 * 8/2016 Sturgess ..... H01R 4/4881
2018/0333815 A1 * 11/2018 Saito ..... B23Q 3/18
2018/0337479 A1 * 11/2018 Machida ..... H01R 4/184

FOREIGN PATENT DOCUMENTS

DE 102013217256 B3 3/2015
EP 1069652 A1 1/2001
JP 2002075543 A 3/2002
WO WO-2015002111 A1 3/2016

* cited by examiner

RADIAL CONTACT SOCKET

RELATED APPLICATIONS

This application is a national stage application of International Application No. PCT/EP2016/080853, filed Dec. 13, 2016, which claims priority to German Patent Application No. 20 2016 100 095.5, filed Jan. 12, 2016, the entire disclosures of which are hereby incorporated by reference.

The invention relates to an electrical plug-connector socket which is configured as a radial contact socket and has a plurality of longitudinal contact elements for making contact with a corresponding plug pin and also has a sleeve which surrounds the longitudinal contact elements.

The present invention further relates to a method for producing an electrical plug-connector socket formed with a plurality of longitudinal contact elements for making contact with a corresponding plug and having a socket sleeve which surrounds the longitudinal contact elements.

US 2002/0187686 A1 discloses a socket having a T-shaped connection and also the manufacture of a lamella contact, comprising a lamella cage and a rolled contact holder which can be turned in the form of an "hourglass" in a complex manner and with the aid of various tools.

Similarly, U.S. Pat. No. 4,657,335 describes a socket which is formed by a relative rotational movement of the ends of a lamella cage into a sleeve. Rings are placed one over the other at the respective ends of the sleeve in order to secure the lamella cage in the sleeve.

US 2003/0068931 A1 discloses an electrical plug-connector socket comprising a substantially cylindrical socket sleeve which is provided with recesses at its end-side ends in order to fasten a hyperbolically rotated lamella cage, with its connection tongues, to or in said recesses.

DE 10 2011 105 821 B4 further discloses an electrical plug-connector socket having a cylindrical socket sleeve, wherein the socket sleeve is formed with a receiving space in which a hyperbolically rotated lamella cage is fitted, and the socket sleeve has a first and a second end face and the lamella cage, by way of connection tongues, is connected in an interlocking manner to the socket sleeve on the first and the second end face of said socket sleeve and that apertures are made in the transition region between the socket sleeve and the connection tongue, and that at least one of the connection tongues of the lamella cage protrudes through one of the apertures.

The solutions known in the prior art all have the disadvantage that manufacture is very complicated, in particular the geometric dimensions of sleeves, end-side sleeves and lamella cages also have to be matched to one another. Manufacturing considerations lead to a tolerance field, and this creates considerable practical problems. In general, high-precision pipes have to be used since, in each case, the inner pipe of the lamella cage has to fit into the pipe shape of the surrounding sleeve and the surrounding sleeve in turn may have to be inserted into a further sleeve receptacle and have to be fastened there.

There is generally also a problem of the lamella cage twisting in the sleeve, so that holding apparatuses have to be provided between the sleeve and the lamella cage in order to firstly secure the cage in the sleeve with the ability to rotate and secondly to engage in the cage with a tool in order to twist said cage about its center axis so that the contact lamellae are constricted in the interior.

Contact systems of the kind in which a cylindrical, in particular cylindrically rolled, contact grid is fastened to the two end-side collar webs in the sleeve surrounding the contact grid and thus is clamped on both sides present a further quite considerable problem.

Therefore, in general, plug-connector sockets of the generic type comprise an inserted contact grid which is connected to the sleeve by means of complicated material joining methods (such as welding for example).

In the case of a conventional contact grid which is attached on both sides, a large number of problems occur in application since the contact system is mechanically overdetermined. As a result, increased loading occurs at the two clamping points during the plug-in process and during subsequent operation due to vibration, active forces and thermomechanical effects since the contact, in particular after the insertion of a corresponding pin, is clamped such that it cannot, as it were, avoid any of the above-mentioned forces.

The object of the present invention is therefore to overcome the abovementioned disadvantages and to manufacture a plug-connector socket in a substantially simpler and more economical manner, wherein, at the same time, the number of components is intended to be reduced but a high current-carrying capacity is still ensured under a high temperature loading, in particular at temperatures of between 150° and 170°, and in some cases has to be reliably ensured at higher temperatures.

The invention is achieved by a plug-connector socket having the features of claim 1.

The basic idea of the present invention is to not clamp the cylindrical lamella cage at both ends as in the prior art, but rather to clamp the lamella cage at least axially and further preferably also in a rotationally fixed manner at the one (first) end and to provide a "floating bearing" or an axial and rotatable sliding bearing at the other (second) end.

In a preferred refinement of the invention, it is provided that the lamella cage is fastened at its second end to the sleeve, which surrounds the lamella cage, such that it can rotate through a small angle $\alpha$.

As a result, an electrical plug-connector socket comprising a cylindrical socket sleeve is provided according to the invention, wherein the socket sleeve is formed with a receiving space in which a cylindrical lamella cage having a large number of contact lamellae which run in parallel is inserted, wherein the lamella cage has a first and a second end-side circumferential collar web, the contact lamellae running between said collar webs, characterized in that the lamella cage is clamped and/or fastened at least axially and preferably also in a rotationally fixed manner in the socket sleeve at the one (first) end and an axial sliding bearing which can be rotated at least through a certain rotary angle, in relation to the socket sleeve, is provided at the other (second) opposite end.

In a preferred embodiment, the lamella cage, by way of one of its collar webs, is fastened to the inner wall of the socket sleeve by means of sleeve-side fastening means.

In a further preferred embodiment, the lamella cage, by way of its second collar web, is mounted in an axially moving and sliding manner on the inner wall of the socket sleeve.

It is further advantageous when two or more window-like recesses or openings, each with a length L as viewed in axial direction A, are provided on the first collar web, convex portions which are respectively provided on the inner wall of the socket sleeve and have a respectively virtually identical length L' engaging into said recesses or openings, so that axial movement of this collar web is prevented in this way.

It can advantageously also be provided that window-like recesses with a width B as viewed transverse to the axial direction are provided on the first collar web, convex portions which are provided on the inner wall of the socket sleeve and have an identical or a smaller width B' engaging into said recesses. As a result, mounting is simplified and it is further ensured that a certain rotary mounting of the collar web in relation to the socket sleeve is provided, wherein the extent of the rotation depends on the size of the width differences between the width B and the width B' that has been selected. A rotary angle distance of 2° to 4° is preferably selected, so that firstly good holding and secondly simpler mounting are ensured.

In a further advantageous refinement of the invention, the fastening means can be provided on the socket sleeve as stamped portions in the casing of the socket sleeve, wherein indentations are formed on the outer almond of the socket sleeve and projecting convex portions are formed on the inner casing of the socket sleeve. The positions of the convex portions are matched in a corresponding manner to the positions of the window-like openings.

It is further preferred when the fastening means are in the form of substantially cuboidal convex portions with in each case two opposite longitudinal side edges and in each case two opposite lateral side edges, so that there are defined stops and boundary edges for supporting one of the collar webs and the window-like recesses can be formed with a shape which corresponds thereto.

In an advantageous refinement of the lamella cage, this can have a smaller diameter in its central middle section as viewed in axial direction than the diameter at the collar webs.

A further aspect of the present invention relates to a method for producing an electrical plug-connector socket as described above, comprising the following method steps:

a. producing a contact lamella grid with two end-side collar webs having a large number of parallel contact lamellae which run between said collar webs;
b. making two or more window-like openings (at selected positions) in one of the collar webs of the contact lamella grid and transforming the contact lamella grid into a cylindrical shape,
c. providing a suitably shaped socket sleeve with a receiving space for receiving the cylindrical contact lamella grid and fitting convex portions, which protrude into the receiving space, (corresponding to the positions of the openings in step b) to the inner casing of the socket sleeve, preferably by stamping, and
d. introducing the cylindrical contact lamella grid into the receiving space in such a way that the convex portions engage in the window-like openings and secure the one collar web.

It is preferred when, in this case, the length L of the respective openings is matched to the length L' of the respective convex portions such that the one collar web cannot move in the axial direction.

Figure 2:
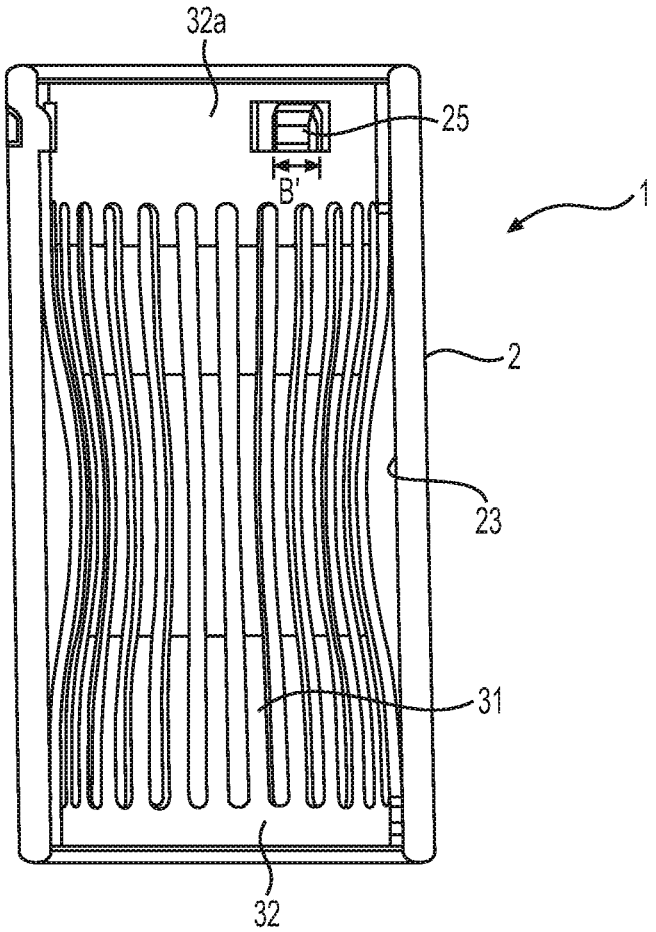

Further refinements of the invention can be gathered from the patent claims and also the figures and the associated description of the figures, wherein in the figures of the drawings the following is shown:

The invention will be explained in more detail below with reference to the following exemplary embodiment which is illustrated in FIGS. 1 and 2. FIGS. 1 and 2 are perspective and plan views, respectively, of the socket in section, according to an exemplary embodiment of the invention. In so doing, identical reference symbols indicate identical functional or structural features.

The figures illustrate a half-open side view of an electrical plug-connector socket 1 comprising a cylindrical socket sleeve 2, wherein the socket sleeve 2 is formed with a receiving space 20 in which a cylindrical lamella cage 3 having a large number of contact lamellae 31, which run in parallel, is inserted.

The cylindrical and tubular socket sleeve 2 has a casing 7 which is closed at the circumference and is open at the two ends.

The lamella cage 3 has a first and a second end-side circumferential collar web 32*a*, 32*b*, a large number of contact lamellae 31 running between said collar webs. The contact lamellae 31 run substantially parallel to one another so as to form a gap between in each case two adjacent contact lamellae 31.

The lamella cage 3 is clamped and fastened at least axially and preferably also in a rotationally fixed manner in the socket sleeve 2 at the one (first) end and an axial and rotatable sliding bearing in relation to the socket sleeve 2 is provided at the other (second) opposite end of the lamella cage 3.

As is further shown in FIGS. 1 and 2, the lamella cage 3, by way of one of its collar webs 32*a*, is fastened to the inner wall 23 of the socket sleeve 2 by means of fastening means 25. To this end, three fastening means 25 are provided in the circumferential direction.

Furthermore, the lamella cage 3, by way of its second collar web 32*b*, is mounted in an axially moving and sliding manner on the inner wall 23 of the socket sleeve 2 and therefore not clamped, as intended. During the insertion process with an insertion pin, not illustrated, the contact lamellae 31 are deformed in the radial direction since the lamella cage 3 has a constriction in its middle central section and accordingly has a smaller diameter. To this end, the contact pin has a larger diameter than the lamella cage 3 in its middle central section. The one-sided sliding bearing of the collar web 32*b* allows axial movement of said collar web. Since the deflection is reversible, the lamella cage 3 returns to its original shape as soon as the contact pin has been removed again. The same relative movement is made possible in the event of vibrations, under thermomechanical heating etc., so that plastic deformation and weakening of the contact system are avoided.

Three window-like recesses or openings 35 are provided on the first collar web 32*a*, one said window-like recess or opening being shown in the views of FIGS. 1 and 2. The openings are each provided with a length L as viewed in the axial direction A, the convex portions 25 of a respectively virtually identical length L', which convex portions are respectively provided on the inner wall 23 of the socket sleeve 2, engaging into said openings, so that axial movement of this collar web 32*a* is prevented in this way.

The window-like recesses 35 on the first collar web 32*a* are further formed with a width B as viewed transverse to the axial direction A, the convex portions 25 of a smaller width B' engaging in said recesses.

Furthermore, indentations 26 are formed on the outer almond 24 of the socket sleeve 2 and projecting convex portions 25 are formed in the casing 7 opposite said indentations.

The implementation of the invention is not restricted to the preferred exemplary embodiments described above. Rather, a number of variants are feasible which make use of the illustrated solution even for embodiments of a fundamentally different nature.

The invention claimed is:

1. An electrical plug-connector socket comprising:

a cylindrical socket sleeve that has first and second opposite ends and a receiving space in which a cylindrical lamella cage having a number of contact lamellae, wherein the lamella cage has a first and a second end-side circumferential collar web, the contact lamellae running between said first and second collar webs, wherein the lamella cage is fastened at least axially in the socket sleeve at the first end and has an axial and rotatable sliding bearing in relation to the socket sleeve, wherein window-like recesses or openings with a width as viewed transverse to an axial direction are provided on the first collar web, and convex portions are provided on an inner wall of the socket sleeve and have a smaller width than the width of the window-like recesses or openings, each of the convex portions engaging into one or said recesses or openings.

2. The electrical plug-connector socket as claimed in claim 1, wherein the lamella cage, by way of one of the first or second collar webs, is fastened to an inner wall of the socket sleeve.

3. The electrical plug-connector socket as claimed in claim 2, wherein fastening means are provided on the socket sleeve as stamped portions in a casing of the socket sleeve, wherein indentations are formed on an outer surface of the socket sleeve positioned where the convex portions are formed on the inner wall of the socket sleeve.

4. The electrical plug-connector socket as claimed in claim 3 wherein the fastening means are in the form of substantially cuboidal convex portions with in each case two opposite longitudinal side edges and in each case two opposite lateral side edges.

5. The electrical plug-connector socket as claimed in claim 1, wherein the lamella cage, by way of the second collar web, is mounted in an axially moving and sliding manner on an inner wall of the socket sleeve.

6. The electrical plug-connector socket as claimed in claim 1, wherein each of the window-like recesses or openings each have a length as viewed in the axial direction and each of the convex portions have a respectively substantially identical length engaging into said window-like recesses or openings, so that axial movement of the first collar web is prevented.

7. The electrical plug-connector socket as claimed in claim 1, wherein the lamella cage has a smaller diameter in a central middle section thereof as viewed in an axial direction than at the collar webs.

8. A radial contact socket, comprising:

a cylindrical socket sleeve having first and second opposite ends and a receiving space;

a cylindrical lamella cage received in the receiving space of the socket sleeve, the lamella cage having opposite first and second collar webs and a plurality of contact lamellae running between the first and second collar webs, the first collar web of the lamella cage being axially fixed to the first end of the socket sleeve; and a means for rotational float associated with the socket sleeve and the lamella cage, the means for rotational float allowing limited rotation of the lamella cage with respect to the socket sleeve.

9. The radial contact socket of claim 8, wherein the means for rotational float includes one or more window-like recesses or openings provided on the first collar web of the lamella cage that engage one or more corresponding convex portions provided on an inner wall of the socket sleeve, each of the one or more window-like recesses or openings having with a width as viewed transverse to an axial direction and each of the one or more convex portions having a width that is smaller than the width of the window-like recesses or openings.

10. A radial contact socket, comprising:

a cylindrical socket sleeve having first and second opposite ends and a receiving space;

a cylindrical lamella cage received in the receiving space of the socket sleeve, the lamella cage having opposite first and second collar webs and a plurality of contact lamellae running between the first and second collar webs, the first collar web of the lamella cage being axially fixed to the first end of the socket sleeve;

one or more window-like recesses or openings provided on the first collar web of the lamella cage and each having with a width as viewed transverse to an axial direction;

one or more convex portions provided on an inner wall of the socket sleeve that correspond to the one or more window-like recesses or openings, wherein each of the one or more convex portions has a smaller width that is smaller than the width of the window-like recesses or openings, the smaller width providing limited rotational float between the lamella cage and the socket sleeve.

* * * * *